US010826246B2

(12) United States Patent
Zhang et al.

(10) Patent No.: US 10,826,246 B2
(45) Date of Patent: Nov. 3, 2020

(54) CONTACT ARRANGEMENT OF ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Wei-Liang Zhang, Kunshan (CN); Jian-Long Hu, Kunshan (CN); Xiang-Dong Wang, Kunshan (CN); Dao-Zhen Bian, Kunshan (CN); Wen-Ming Wu, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/544,849

(22) Filed: Aug. 19, 2019

(65) Prior Publication Data

US 2020/0059044 A1 Feb. 20, 2020

(30) Foreign Application Priority Data

Aug. 17, 2018 (CN) ..... 2018 2 1338757 U

(51) Int. Cl.
*H01R 13/6587* (2011.01)
*H01R 12/72* (2011.01)

(52) U.S. Cl.
CPC ..... *H01R 13/6587* (2013.01); *H01R 12/727* (2013.01); *H01R 12/725* (2013.01)

(58) Field of Classification Search
CPC .. H01R 12/725; H01R 12/57; H01R 13/6471; H01R 13/6587; H01R 12/727
See application file for complete search history.

(56) References Cited

U.S. PATENT DOCUMENTS 8,506,332 B2 * 8/2013 Sommers ..... H01R 12/707 439/607.34
9,496,651 B2 * 11/2016 Jeong ..... H01R 13/6471
(Continued)

FOREIGN PATENT DOCUMENTS

TW M419303 12/2011
TW I612736 1/2018

*Primary Examiner* — Nguyen Tran
*Assistant Examiner* — Paul D Baillargeon
(74) *Attorney, Agent, or Firm* — Wei Te Chung; Ming Chieh Chang

(57) ABSTRACT

An electrical connector includes an insulative housing and a plurality of contacts retained within the housing as a contact module. The housing includes a base and a mating tongue forwardly extending from the base. The contacts are arranged with two rows contacting sections respectively exposed upon two opposite surfaces of the mating tongue, and one row mounting sections for mounting to a same plane of a printed circuit board. Each contact has a linking section between the contacting section and the mounting section. The contacts are grouped by one grounding contact associated with a pair of neighboring differential pair signal contacts in an isosceles triangular configuration wherein the grounding contact is located at the top apex. The linking section of grounding contact of the outermost group is widened compared with those of the remaining contacts for lowering the corresponding impedance.

11 Claims, 10 Drawing Sheets

(56) References Cited

U.S. PATENT DOCUMENTS

| | | | | |
|---|---|---|---|---|
| 9,917,391 | B2 * | 3/2018 | Zhang | H01R 24/60 |
| 2016/0352052 | A1 * | 12/2016 | Yu | H01R 13/6585 |
| 2017/0018883 | A1 * | 1/2017 | Chen | H01R 13/6585 |
| 2018/0006408 | A1 * | 1/2018 | Wen | H01R 24/62 |

* cited by examiner

CONTACT ARRANGEMENT OF ELECTRICAL CONNECTOR

BACKGROUND OF THE INVENTION

1. Field of the Invention

The present invention relates generally to an electrical connector, and particularly to an electrical connector having corresponding contacts integrally formed within an insulative housing via a single insert-molding shot with the corresponding contacting sections exposed upon two opposite surfaces of the mating tongue of the housing.

2. Description of Related Arts

HDMI (High-Definition Multimedia Interface) connector may support 18 Gbps transmission speed for 4K resolution display. Anyhow, for the 8K or 10K resolution display, it is required to modify the arrangement of the current HDMI connector structure for increased high speed transmission. Understandably, the typical HDMI contacts are arranged with groups each having one pair of differential pair signal contacts associated with one grounding contact respectively located at three apexes of an isosceles triangle in a cross-section of the mating interface of the mating tongue of the HDMI connector wherein the grounding contact is located at the top apex. One problem of the high speed transmission for the current design is regarding the outer signal contact of the differential pair signal contacts of the outmost group lacks another grounding contact of the neighboring group for adjust its impedance. Understandably, each signal contact of all other differential pair signal contacts except such outer signal contact of the outermost group, has two grounding contacts beside for adjustment of its own impedance, i.e., one being of its own group and the other being of the neighboring group. Therefore, it is required to make some change for the outermost group so as to adjust the required/desired impedance of the outermost differential pair signal contacts for high speed transmission.

SUMMARY OF THE INVENTION

An object of the invention is to provide an electrical connector with an insulative housing and a plurality of contacts retained within the housing as a contact module. The housing includes a base and a mating tongue forwardly extending from the base. The contacts are arranged with two rows contacting sections respectively exposed upon two opposite surfaces of the mating tongue, and one row mounting sections for mounting to a same plane of a printed circuit board. Each contact has a linking section between the contacting section and the mounting section. The contacts are grouped by one grounding contact associated with a pair of neighboring differential pair signal contacts in an isosceles triangular configuration wherein the grounding contact is located at the top apex. The linking section of grounding contact of the outermost group is widened compared with those of the remaining contacts for lowering the corresponding impedance.

Another feature of the invention is to have all contacts integrally formed within the housing via a signal shot injection molding wherein the front ends of all contacts are located at a same level of the mating tongue.

DETAILED DESCRIPTION OF THE PREFERRED EMBODIMENT

Figure 1:
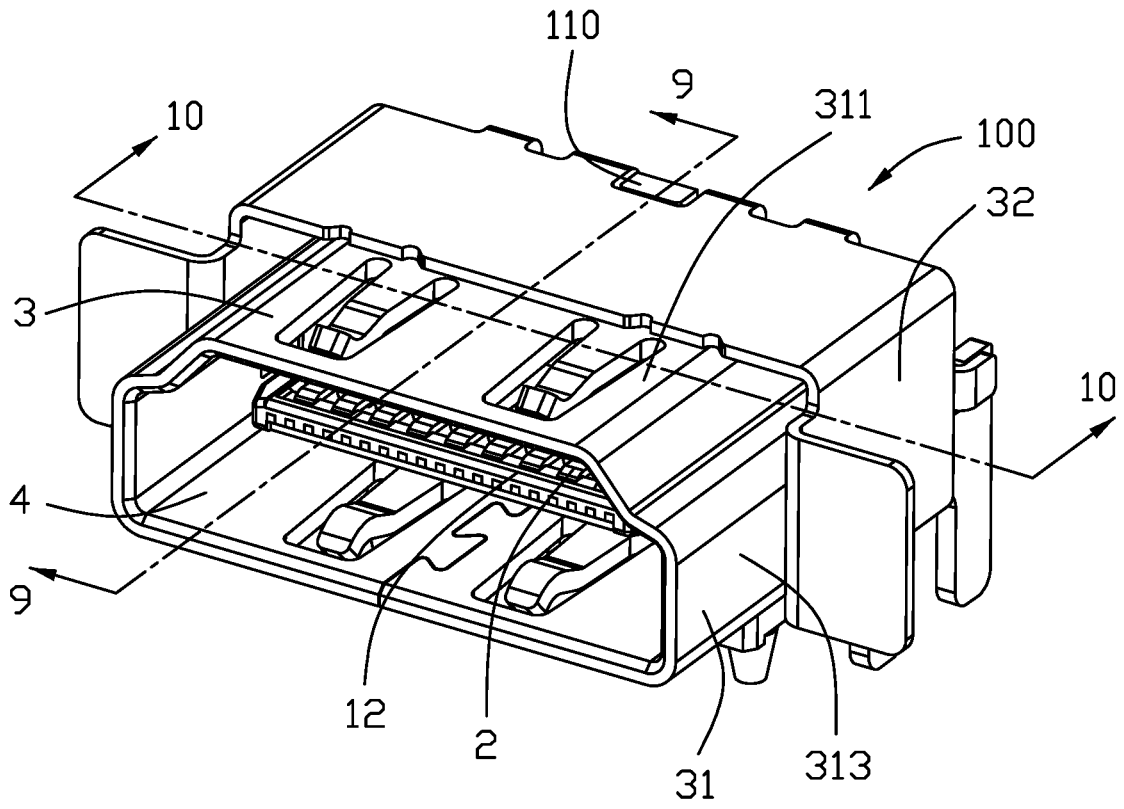
FIG. 1 is a perspective view of the electrical connector according to the invention.
Figure 2:
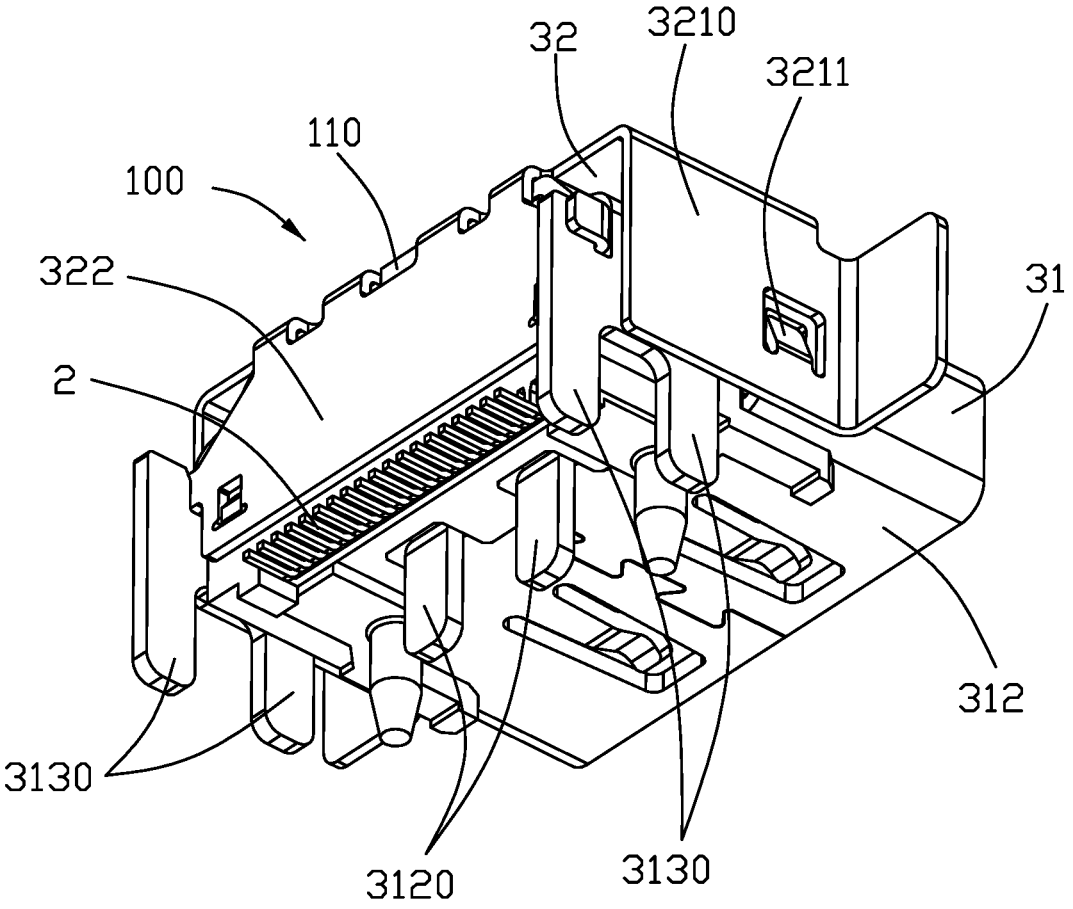
FIG. 2 is another perspective view of the electrical connector of FIG. 1.
Figure 3:
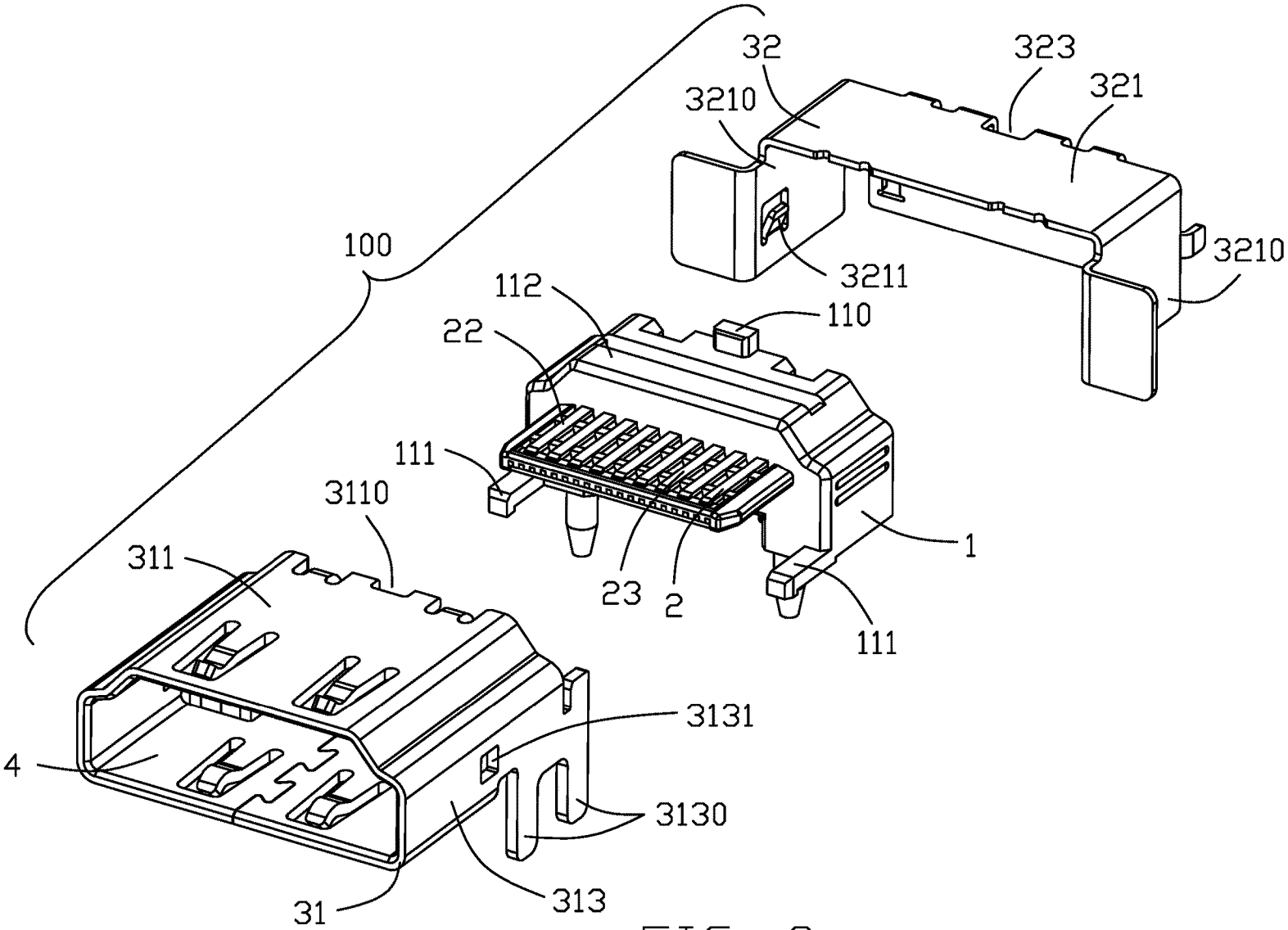
FIG. 3 is an exploded perspective view of the electrical connector of FIG. 1.
Figure 4:
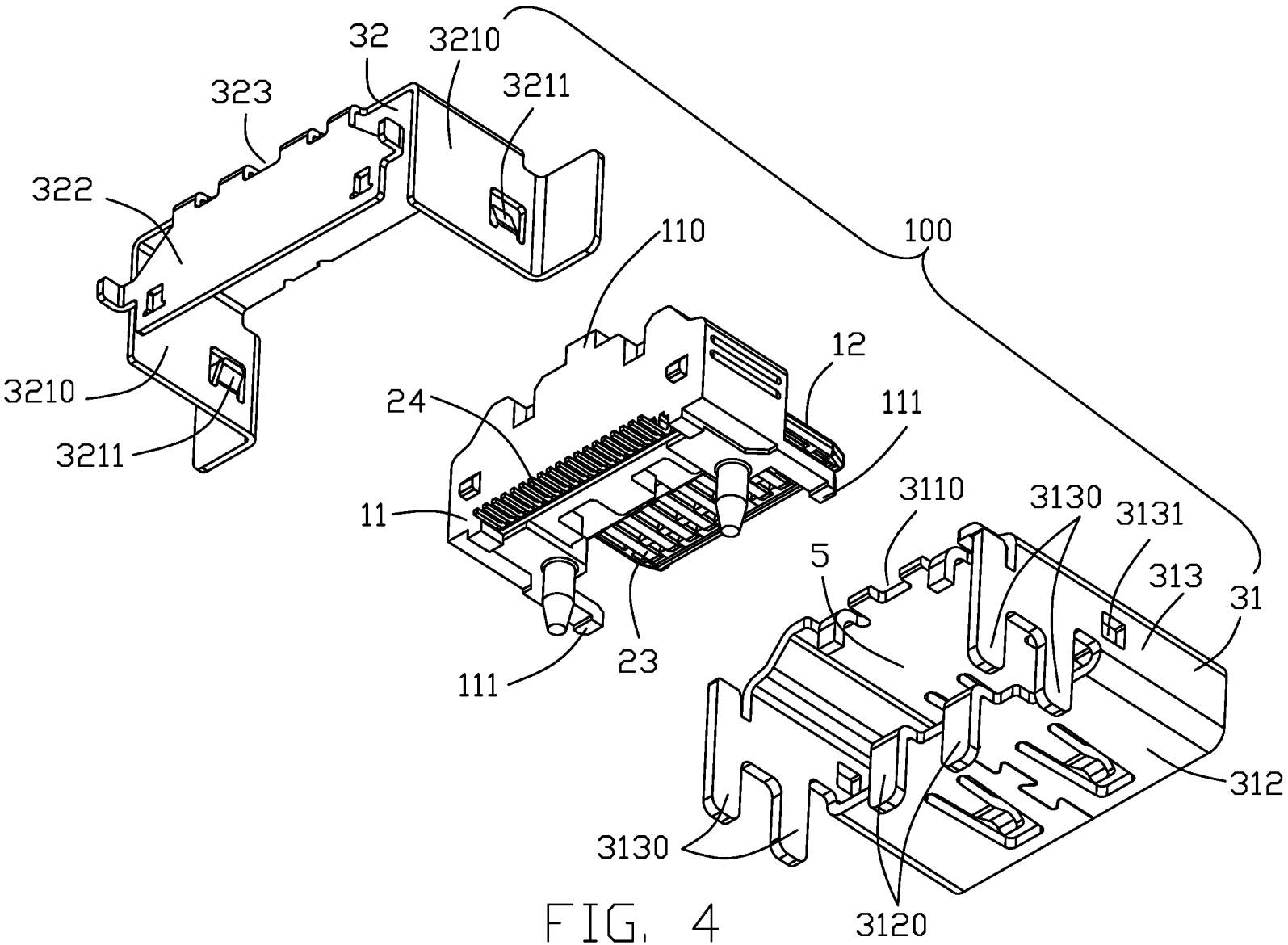
FIG. 4 is another exploded perspective view of the electrical connector of FIG. 3.
Figure 5:
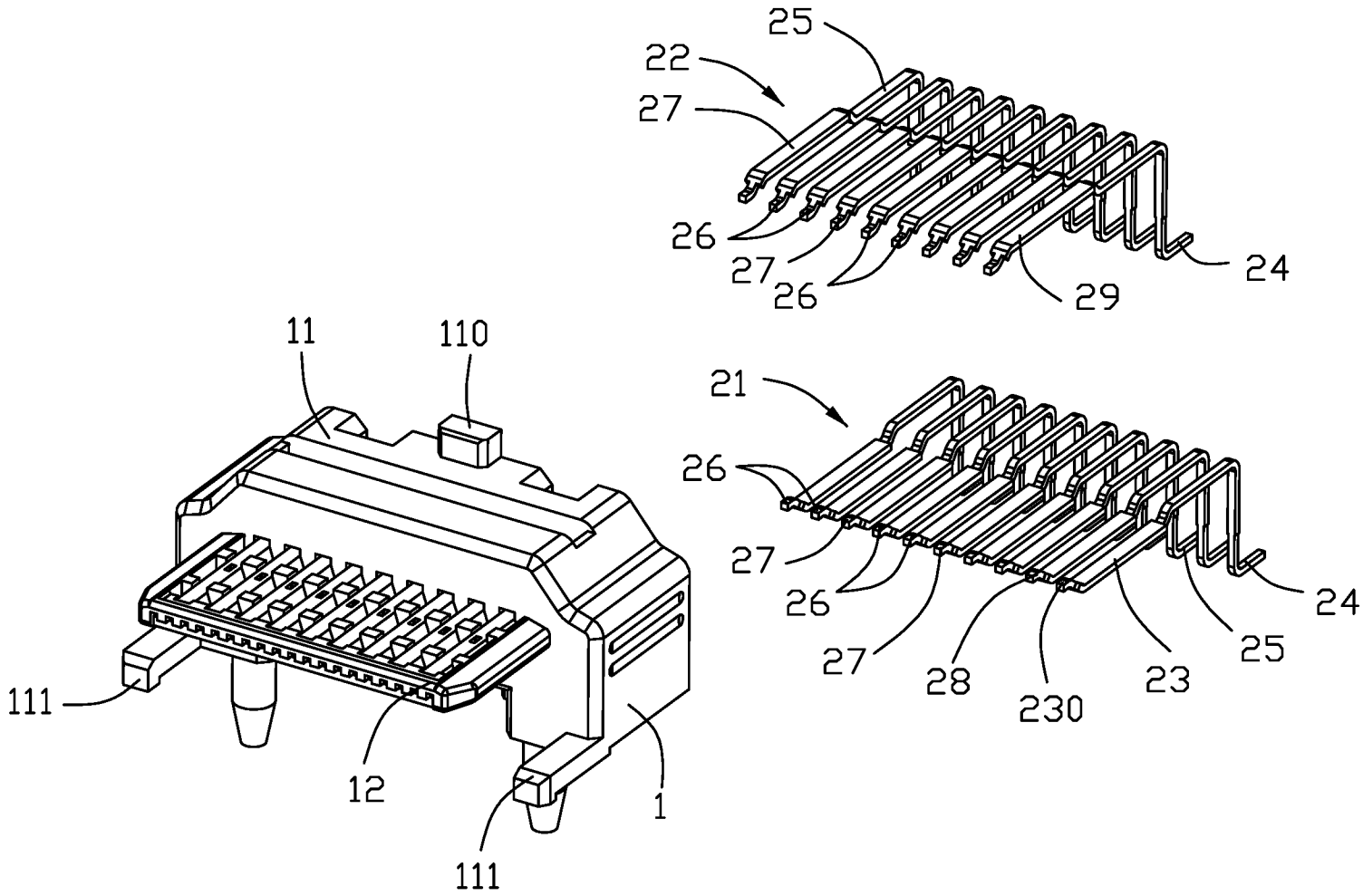
FIG. 5 is an exploded perspective view of the contact module of the electrical connector of FIG. 1.
Figure 6:
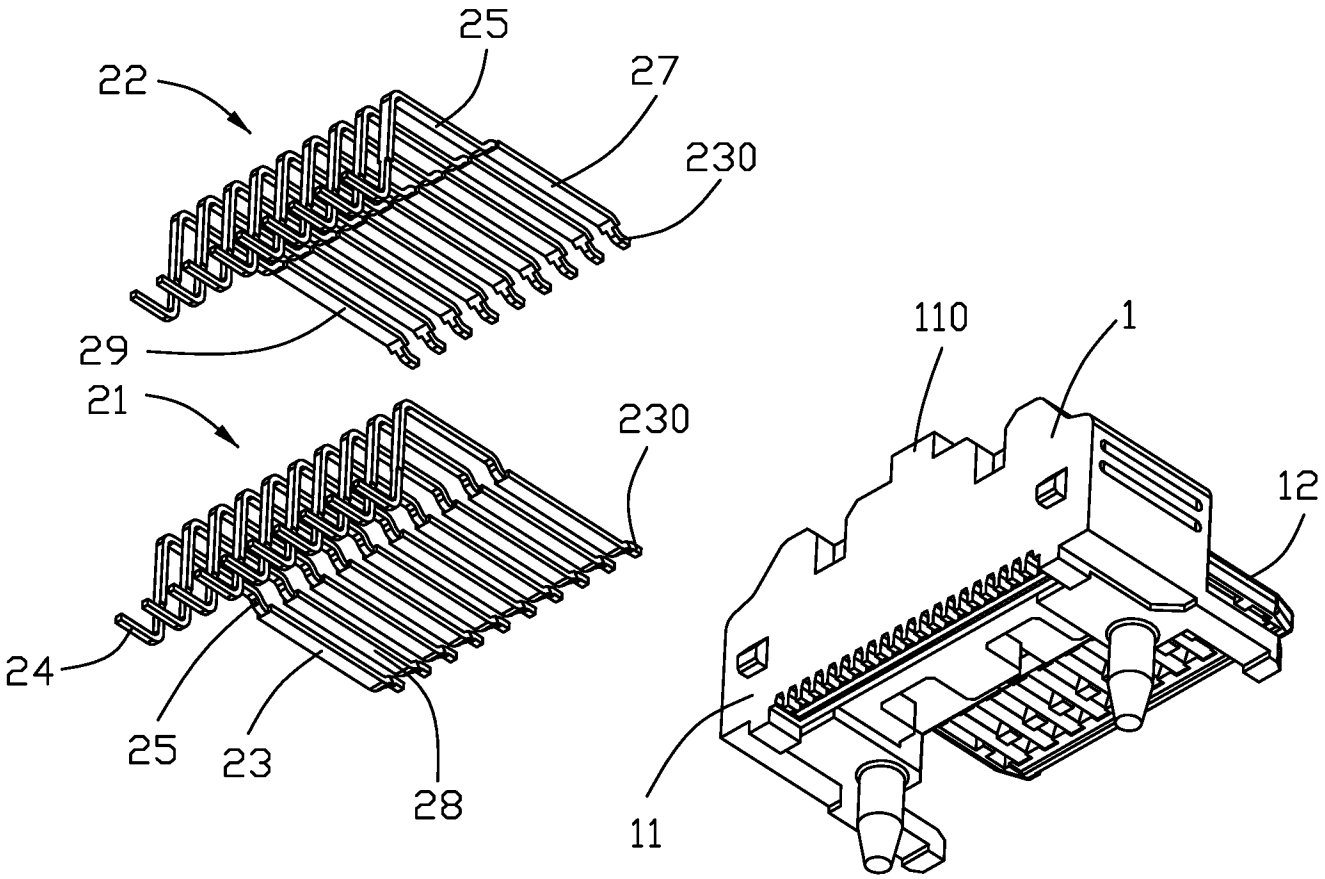
FIG. 6 is another exploded perspective view of the contact module of the electrical connector of FIG. 5.

Referring to FIGS. 1-10, an HDMI electrical connector 100 for mounting to a printed circuit board (not shown) and mated with a plug connector (not shown), includes a contact module composed of an insulative housing 1 and a plurality of contacts 2 integrally formed within the housing 1 via a one shot injection molding process. The housing includes a base 11 and a mating tongue 12 forwardly extending from the base 11. Each contact 2 has a front contacting section 23 exposed upon the mating tongue 12, a mounting section 24 extending out of the base 11, and a linking section 25 linked between the contacting section 23 and the mounting section 24. The contacts 2 include a first row contacts 21 and the second row contacts 2 alternately arranged with each other along the transverse direction. The first row contacts 21 and the second row contacts 22 commonly form a first group 201 having a pair of differential pair signal contacts 26 of the first row contacts 21 and a grounding/shielding contact 27 of the second row contacts 22. Notably, the pair of differential pair signal contacts 26 of the first row contacts 21 and the corresponding grounding contact 27 of the second row contacts 22 in the first group commonly form an isosceles triangle in a cross-sectional view wherein the grounding contact 27 is located at the center apex. Clearly, the first group 201 is located at the outer most position of the contacts 2. In other words, the outer differential pair signal contact 26 in the first group 201 has no neighboring contact on its outer side, thus affecting the corresponding impedance thereof compared with other (internal) groups having the neighboring contacts by two sides thereof. Therefore, the corresponding grounding contact 27 has some difference compared with the grounding contacts 27 of the other group. Specifically, the linking section 25 of the grounding contact 27 of the first group 201 has a (wider) width of 0.35 mm while those of grounding contacts of other groups has a (narrower) width of 0.25 mm only. Understandably, such a difference is to compensate the impedance difference or lower the impedance thereof due to lacking the neighboring contact of the outer differential pair signal contact 26 of the first group 201.

Figure 7:
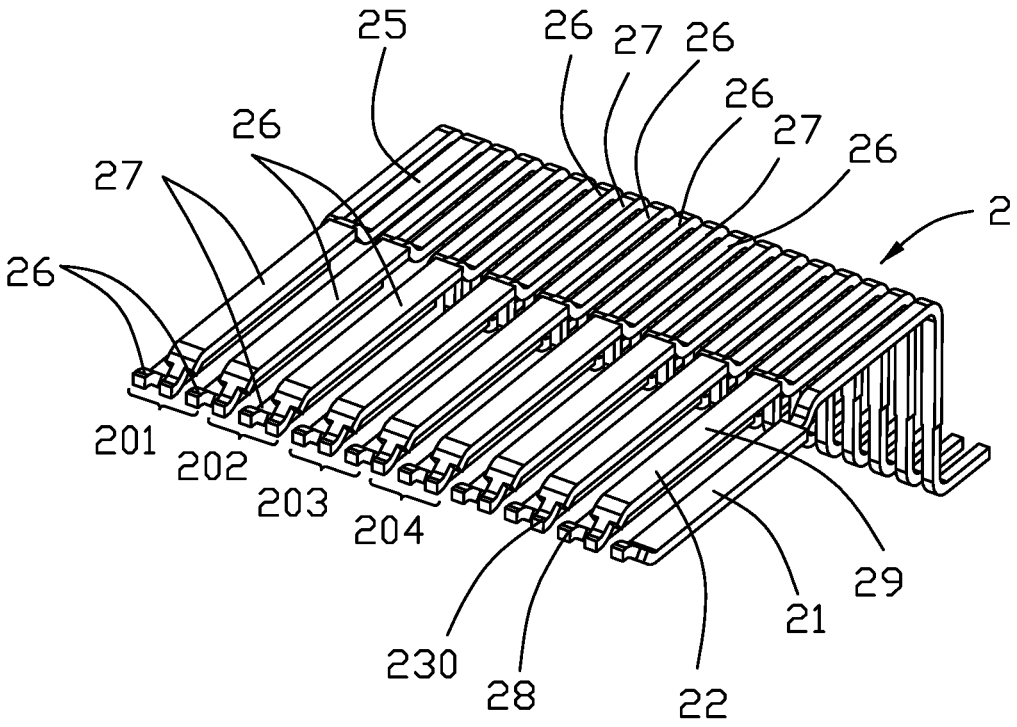
FIG. 7 is a perspective view of the contacts of the contact module of the electrical connector of FIG. 5.
Figure 8:
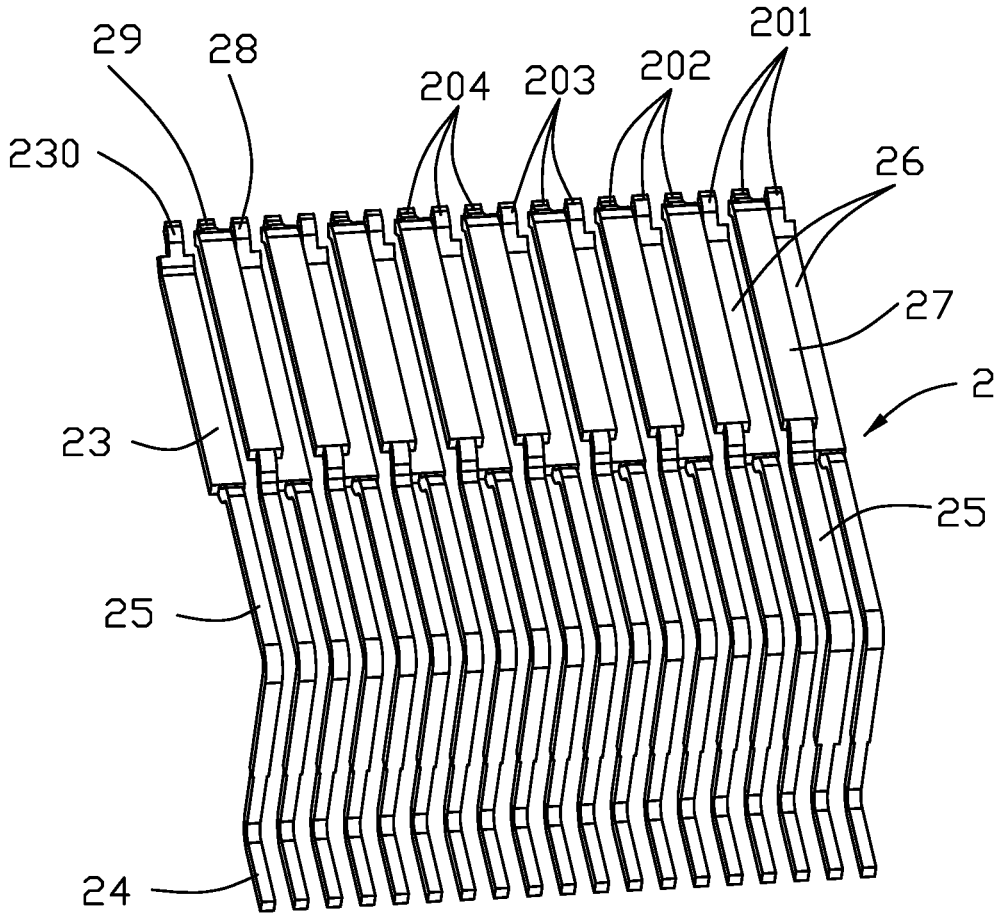
FIG. 8 is another perspective view of the contacts of the contact module of the electrical connector of FIG. 7.

As shown in FIGS. 7-8, the first row contacts 21 and the second row contacts 22 further include with the same pattern, i.e., the pair of differential pair signal contacts 26 being in one row while the grounding contact 27 in the other row, the second group 202, the third group 203 and the fourth group 204 each of which forms the isosceles triangular cross-section with the corresponding grounding contact at the center apex, and such triangular configurations of the all the first group 201, the second group 202, the third group 203 and the fourth group 204 are essentially alternately arranged in a staggered mutually reversed manner, i.e., one upstanding type and one upside-down type alternately arranged with each other along the transverse direction. Therefore, the mating interface complies with the HDMI specification wherein there are ten first row contacts 21 and nine second row contacts 22 wherein the first group 201 is located at the leftmost (outermost) side, requiring widening the linking section 25 of the corresponding grounding contact 27. In this embodiment, in the first row contacts 21 there is another grounding contact 28 and a power contact 29. The linking section 25 of the grounding contact 28 may have a width between that of the grounding contact 27 of the first group 201 and those of the remaining contacts 2. For example, the width of the linking section 25 of the grounding contact 27 of the first group 201 is 0.35 mm, that of the grounding contact 28 is 0.3 mm, and those of the remaining contacts 2 are 0.25 mm.

A front end 230 of the contacting section 23 is inwardly bent toward and embedded at the mid-level of the mating tongue 12. The width of the front end 230 is smaller than that of the contacting section 23.

The connector 100 further includes a metallic shell 3 enclosing the housing 1 to form a mating cavity 4 around the mating tongue 12. The shell 3 includes a main shell 31 and a sub-shell 32 attached to the main shell 31. The main shell 31 includes an upper wall 311, a lower wall 312 and two side walls 313 therebetween. Each side wall 313 has the corresponding mounting leg 3130. The sub-shell 32 has the main part 321 covering the top wall 311, and a rear part 322 extending downwardly from the rear edge of the main part 321 to cover the rear face of the base 11. The base 11 further includes a positioning block 110. The upper wall 311 forms a notch 3110 to receive the corresponding positioning block 110, and the sub-shell 32 forms an opening 323 corresponding to the corresponding positioning block 110 too so as to have the hosing 1 retained to the shell 3.

The base 11 includes a pair of supports 111 and the lower wall 312 is seated upon the support 111, and the upper wall 311 is seated upon the upper face 112 of the base 11 so as to allow the main shell 31 to be assembled to the housing along the front-to-back direction. The sub-shell 32 has a plurality of side parts 3210 extending downwardly from the main part 321 to cover the side walls 313. Each side part 3210 has the tab 3211 to be engaged within the corresponding recess 3131 in the corresponding side wall 313 so as to allow the sub-shell 32 to be upwardly assembled to the main shell 31 and assembled together.

Figure 9:
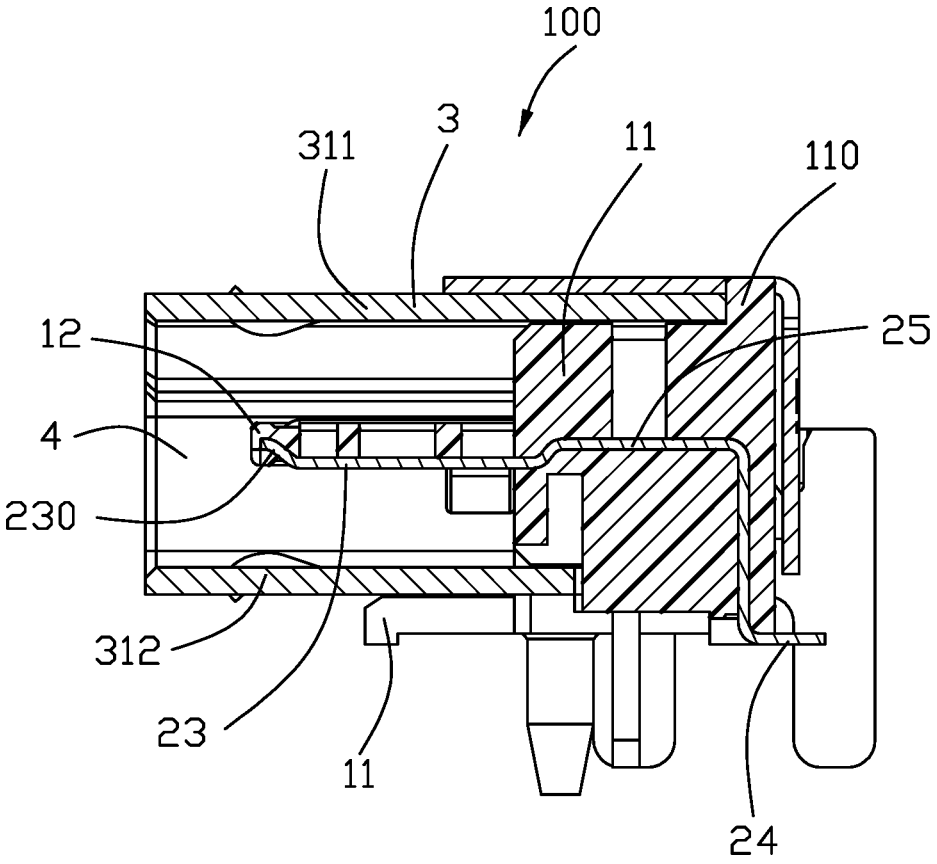
FIG. 9 is a cross-sectional view of the electrical connector of FIG. 1.
Figure 10:
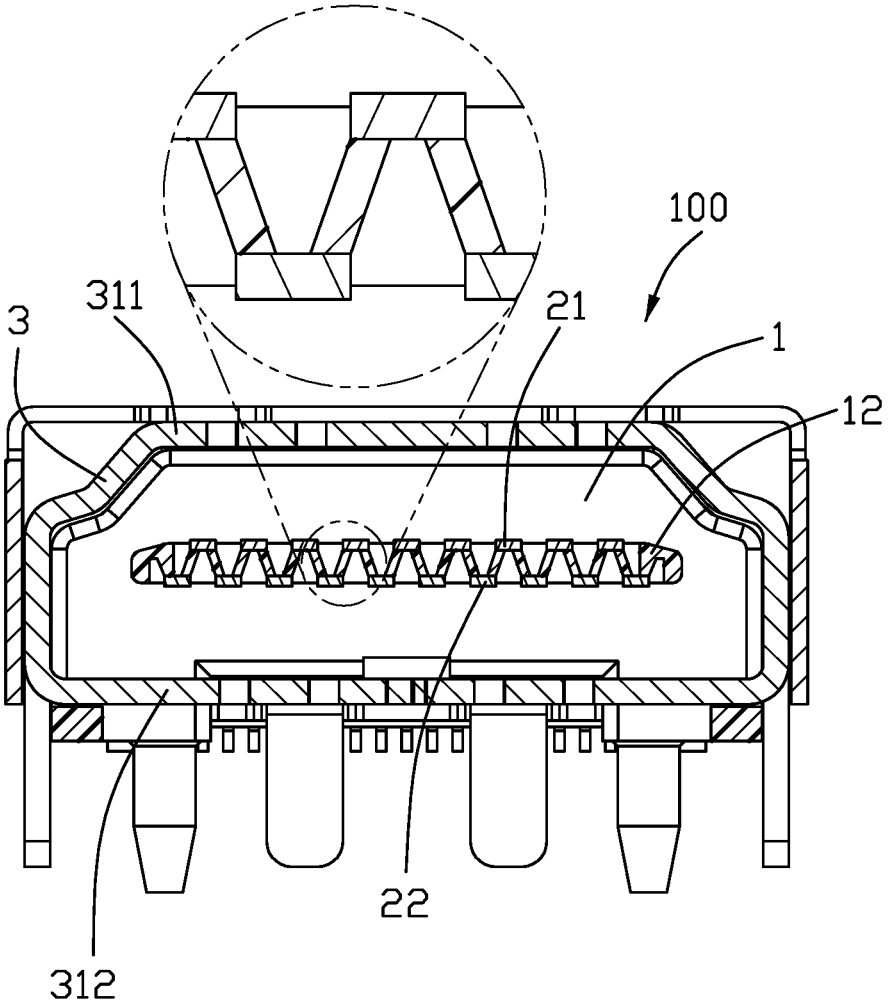
FIG. 10 is another cross-sectional view of the electrical connector of FIG. 1.

One feature of the invention is to increase the width of the connecting section 25 of the outermost grounding/shielding contact 27 in comparison with the remaining contacts 2. Another feature of the invention is regarding the contacts 2 are all integrally formed with the housing 1 in a one shot insert-molding process. To implement such a design, as shown in FIG. 10, the front ends 230 of the contacting sections 23 of all contacts 2 are arranged in a first plane, the linking sections 25 of all the contacts 2 are arranged in a second plane horizontal plane which is essentially coplanar with the first plane in this embodiment, and the mounting sections 24 of all the contacts 2 are arranged in a third plane lower than both the first plane and the second plane. The mating tongue 12 forms a plurality of upward blind holes (not labeled) and a plurality of downward blind holes (not labeled) alternately arranged with each other along the transverse direction where the core pins of the mold are positioned for forming the mating tongue 12 of the housing 1 during injection molding process, wherein each blind forms a trapezoidal cross-section with an larger opening facing toward the exterior in the vertical direction and a small opening covered by the corresponding contacting section 23 in the vertical direction. In addition, as shown in FIG. 9, the housing forms a hole (not labeled) aligned with the linking section 25 of each contact 2 so as to implement the one shot injection molding without risk of tilting of the corresponding linking section 25. The traditional design is essentially to have two rows of contacts respectively inserted into the corresponding passageways in the housing for assembling the whole connector. As shown in FIG. 9, each upward blind hole extends along the front-to-back direction with two supporting blocks (not labeled) which are transversely linked with those of the neighboring downward blind holes for reinforcement of the whole mating tongue 12.

What is claimed is:

1. An electrical connector comprising:

a contact module including:

an insulative housing having a base and a mating tongue forwardly extending from the base in a front-to-back direction, and defining opposite upper and lower mating surfaces in a vertical direction perpendicular to the front-to-back direction;

a plurality of upper row contacts and a plurality of lower row contacts retained in the housing and alternately arranged with each other along a transverse direction perpendicular to both the front-to-back direction and the vertical direction, each of said contact including a front contacting section exposed upon, a rear mounting section and a middle linking section therebetween in the front-to-back direction, wherein the upper row contacts and the lower row contacts having the corresponding contacting sections at the upper mating surface and the lower mating surface respectively while the mounting sections of both the upper row contacts and the lower row contacts are located at a same level;

both the lower row contacts and the upper row contacts being arranged in groups each having a pair of differential pair signal contacts and a grounding contacts arranged with an isosceles triangular configuration in a cross-sectional view, and the isosceles triangular configurations of neighboring groups being reverse with each other; wherein the grounding contact of an outermost group has a widened linking section larger than those of the remaining contacts.

2. The electrical connector as claimed in claim 1, wherein a dimension of the widened linking section of the grounding contact of the outermost group is 0.35 mm while those of remaining contacts are 0.25 mm.

3. The electrical connector as claimed in claim 2, wherein the outermost group has the corresponding pair of differential pair signal contacts of the lower row contacts and the corresponding grounding contact of the upper row contacts.

4. The electrical connector as claimed in claim 3, wherein the lower row contacts further includes a grounding contact having the corresponding linking section of 0.30 mm.

5. The electrical connector as claimed in claim 1, wherein all contacts are integrally formed within the housing via a one shot injection molding process.

6. The electrical connector as claimed in claim 1, wherein the base further includes a pair of supports on two opposite lateral sides.

7. The electrical connector as claimed in claim 6, further including a metallic shell enclosing the housing and supported by pair of supports.

8. The electrical connector as claimed in claim 7, wherein the shell includes a main shell attached upon the housing, and a sub-shell attached upon the main shell.

9. An electrical connector comprising:

a contact module including:

an insulative housing having a base and a mating tongue forwardly extending from the base in a front-to-back direction, and defining opposite upper and lower mating surfaces in a vertical direction perpendicular to the front-to-back direction;

a plurality of upper row contacts and a plurality of lower row contacts retained in the housing and alternately arranged with each other along a transverse direction perpendicular to both the front-to-back direction and the vertical direction, each of said contact including a front contacting section exposed upon, a rear mounting section and a middle linking section therebetween in the front-to-back direction, wherein the upper row contacts and the lower row contacts having the corresponding contacting sections at the upper mating surface and the lower mating surface respectively;

both the lower row contacts and the upper row contacts being arranged in groups each having a pair of differential pair signal contacts and a grounding contacts arranged with an isosceles triangular configuration in a cross-sectional view, and the isosceles triangular configurations of neighboring groups being reverse with each other; wherein the grounding contact of an outermost group has a widened linking section larger than those of the remaining contacts; wherein a metallic main shell enclosing the housing, and a metallic sub-shell enclosing the main shell.

10. The electrical connector as claimed in claim 9, wherein the main shell forms a mounting leg while the sub-shell not.

11. The electrical connector as claimed in claim 10, wherein front ends of the upper row contacts and those of the lower row contacts are located at a same level.

* * * * *